United States Patent [19]

Yamakawa

[11] 4,442,805

[45] Apr. 17, 1984

[54] INTERNAL COMBUSTION ENGINE PROVIDED WITH A PLURALITY OF POWER UNITS

[75] Inventor: Toru Yamakawa, Hachioji, Japan

[73] Assignee: Fuji Jukogyo Kabushiki Kaisha, Tokyo, Japan

[21] Appl. No.: 403,745

[22] PCT Filed: Nov. 30, 1981

[86] PCT No.: PCT/JP81/00363

§ 371 Date: Jul. 29, 1982

§ 102(e) Date: Jul. 29, 1982

[87] PCT Pub. No.: WO82/01914

PCT Pub. Date: Jun. 10, 1982

[30] Foreign Application Priority Data

Nov. 29, 1980 [JP] Japan ..... 55-168785
Nov. 29, 1980 [JP] Japan ..... 55-168790

[51] Int. Cl.[3] ..... F02D 25/04

[52] U.S. Cl. ..... 123/198 F; 123/DIG. 8; 60/716; 60/719

[58] Field of Search ..... 123/198 F, DIG. 8, 2; 60/716, 718, 719

[56] References Cited

U.S. PATENT DOCUMENTS

| | | | |
|---|---|---|---|
| 1,944,256 | 1/1934 | Miller et al. | 123/2 |
| 2,315,183 | 3/1943 | Bicknell et al. | 123/198 F |
| 2,379,288 | 6/1945 | Ericson | 123/198 F |
| 2,392,933 | 1/1946 | Mallory | 123/198 F |
| 2,623,617 | 12/1952 | Snyder et al. | 123/198 F |
| 4,019,479 | 4/1977 | Garabedian | 123/198 F |
| 4,070,994 | 1/1978 | Garabedian | 123/198 F |
| 4,257,371 | 3/1981 | Ishida | 123/198 F |

*Primary Examiner*—Ira S. Lazarus
*Attorney, Agent, or Firm*—Martin A. Farber

[57] ABSTRACT

An internal combustion engine comprising a primary engine unit and an auxiliary engine unit, in which the auxiliary engine unit is connected to an output shaft of the primary engine unit under conditions both engine units are balanced in output torque and engine speed.

1 Claim, 9 Drawing Figures

FIG. 3
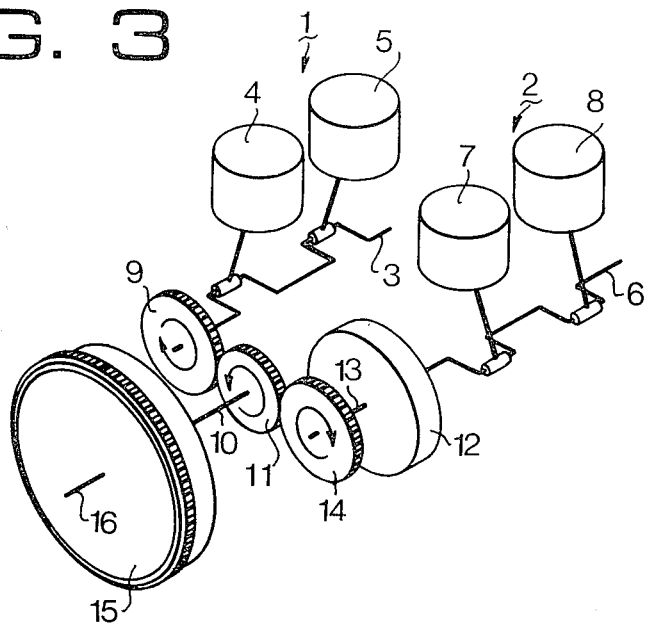
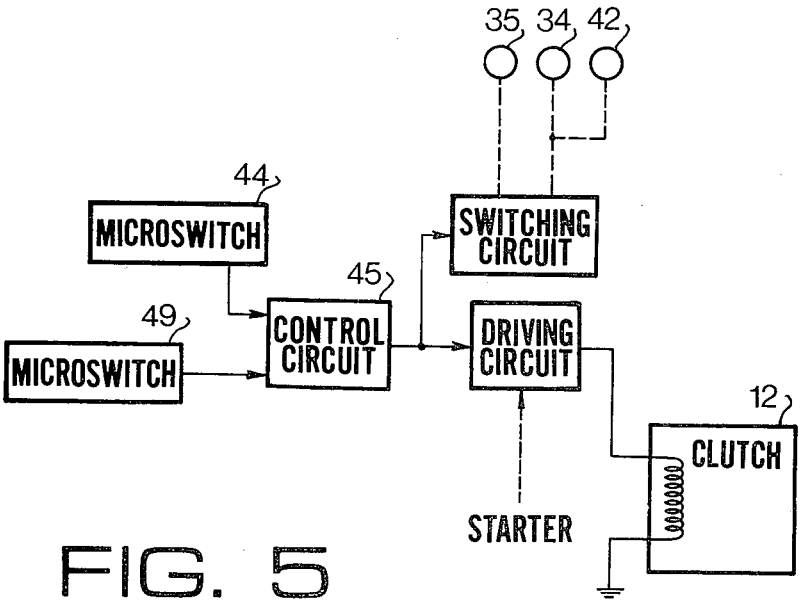
FIG. 5

INTERNAL COMBUSTION ENGINE PROVIDED WITH A PLURALITY OF POWER UNITS

TECHNICAL FIELD

The present invention relates to an internal combustion engine provided with a plurality of independent engine units in which one or more engine units are selectively used in accordance with driving conditions of a vehicle driven by the engine.

BACKGROUND ART

It is preferable to design an engine for a constant load so that a desired torque may generate at a low specific fuel consumption. However, it is difficult to design an engine for driving vehicles so as to have low specific fuel consumption within the entire range of the engine operation, since load on the engine varies in a wide range.

FIG. 1 shows a fuel consumption characteristic of an engine for a vehicle at various specific fuel consumptions (g/ps.hr), in which abscissa is engine speed (r.p.m.), ordinate is engine torque. Curve A shows running load (resistance) of a vehicle on a flat road. The curve A is decided by drag of the body of the vehicle and gear ratio of the transmission of the engine and the specific fuel consumption is decided by the performance of the engine. It is desirable to design the engine so that the curve A may pass through low fuel consumption zones.

DISCLOSURE OF THE INVENTION

The object of the present invention is to provide an engine assembly for a vehicle, which comprises with a plurality of independent engine units, one or more engine units of which are selectively operated in accordance with conditions of the engine operation, whereby the engine assembly is operated in low fuel consumption zones within a wide range of the engine operation.

The engine assembly of the present invention comprises at least two engine units, one of which is a primary engine unit and the other is an auxiliary engine unit. In a low torque range, the primary engine unit is operated, and in a high torque range, the primary and auxiliary units are co-operated to drive the vehicle in accordance with driving conditions of the vehicle.

FIG. 2 shows a fuel consumption characteristic of an engine assembly according to the present invention comprising two engine units. A first zone C is characteristic of the primary engine unit and a second zone E is characteristic of the engine assembly in which the primary engine unit and auxiliary engine unit are combined. The fuel consumption characteristic of the second zone is the same as that of the conventional engine shown in FIG. 1 and the running load curve B is the same as the curve A. Since the curve B passes through a minimum fuel consumption zone D at a low torque operation as shown in FIG. 2, fuel consumption is improved. The auxiliary engine unit is adapted to be started and connected to the output system of the primary engine unit, when the combined power is necessary to drive the vehicle.

In such an engine assembly, it is necessary to balance the fuel supply for the auxiliary engine unit with the fuel supply for the primary engine, when the auxiliary engine unit is connected to the primary engine unit. In other words, both engine units must be connected under conditions that both engine units are balanced in output torque and engine speed. If the engine assembly is not balanced in fuel supply for both engine units, one of the engine units acts on the other engine unit as load, which will cause an increase of fuel consumption and decrease of driveability of the vehicle. However, in such an engine assembly, the auxiliary engine unit is connected to the output system of the primary engine unit when the primary engine unit reaches to the full throttle open operation. Therefore, it is difficult to balance output torques and engine speeds of both engine units under the maximum output torque condition of the primary engine unit.

The present invention is characterized in that, when the auxiliary engine unit is connected to the primary engine unit, a throttle valve of the primary engine unit is closed to a partial open position from a full open position, and a throttle valve of the auxiliary engine unit is opened to a partial open position, and that both throttle valves are opened together from the partial open position to the full open position.

BRIEF DESCRIPTION OF THE DRAWINGS

FIG. 3 is a schematic perspective view of an engine assembly according to the present invention;

FIG. 5 is a block diagram showing a control system for the engine assembly;

BEST MODE FOR EMBODYING THE INVENTION

Figure 1:
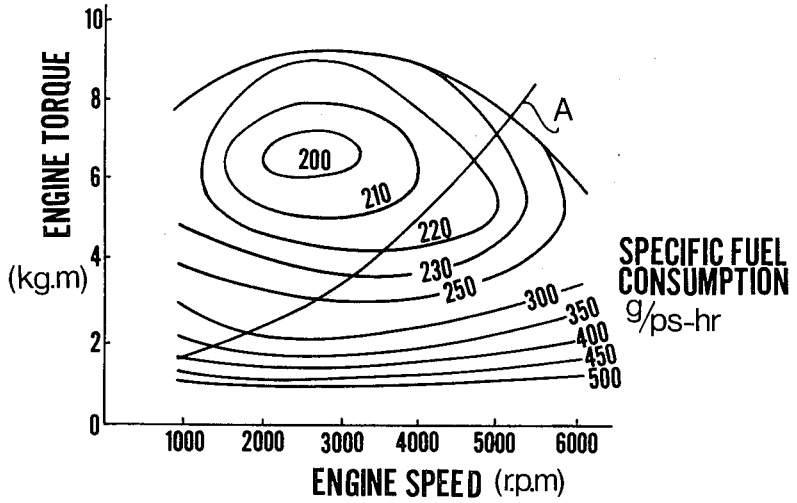
FIG. 1 is a graph showing a fuel consumption characteristic of a conventional engine.

The present invention will be explained in detail hereinafter with reference to FIGS. 3 to 9. The illustrated engine according to the present invention comprises a primary engine unit 1 of two-cylinder, an auxiliary engine unit 2 of two-cylinder.

Pistons 4 and 5 of the primary engine unit 1 are connected to a crankshaft 3 by connecting rods respectively, on the other hand, pistons 7 and 8 of the auxiliary engine unit 2 are connected to a crankshaft 6 by respective connecting rods. A power transmitting gear 9 is securely mounted on the crankshaft 3, and the gear 9 engages with an output gear 11 secured to an output shaft 10. The crankshaft 6 is connected to a transmitting shaft 13 through an electromagnetic powder clutch 12. A transmitting gear 14 on the shaft 13 engages with the output gear 11. On the output shaft 10, a flywheel 15 provided with a clutch and an input shaft 16 is mounted.

Figure 4:
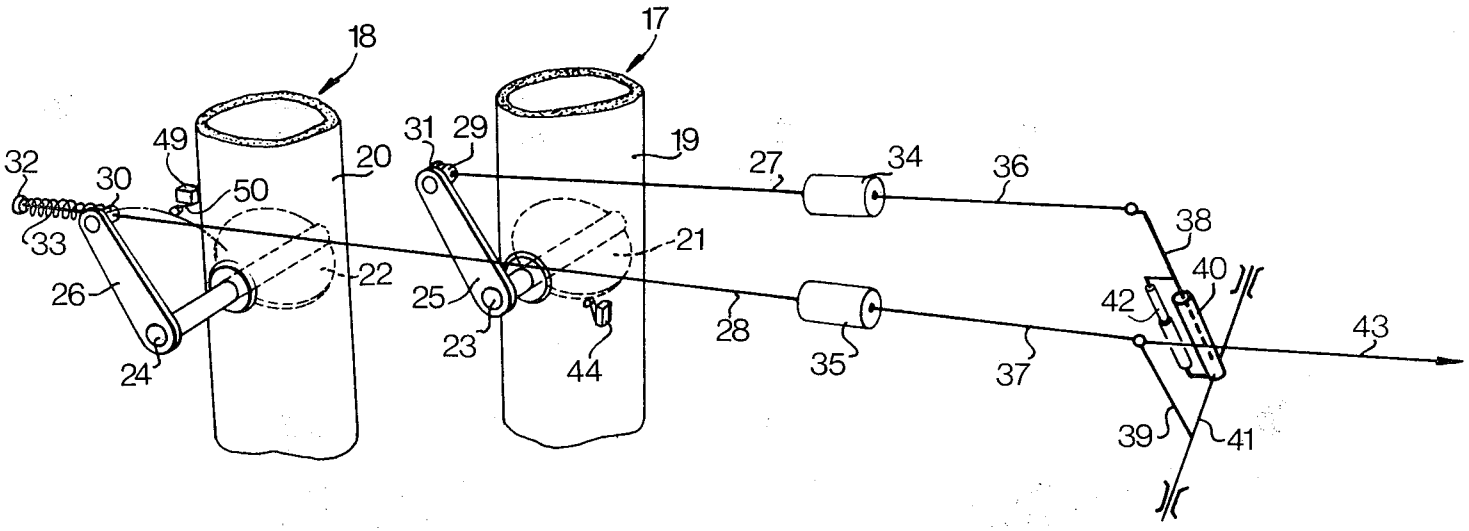
FIG. 4 is a schematic perspective view of a carburetor assembly used for the engine assembly.

Referring to FIG. 4, carburetors 17 and 18 for engine units 1 and 2 comprise parallel barrels 19 and 20, throttle valves 21 and 22 supported by throttle shafts 23 and 24, respectively. Levers 25 and 26 secured to throttle shafts 23 and 24 have pins 29 and 30 each having a hole.

A wire 27 passes through the hole of the pin 29, and a flange 31 is fixed to an end of the wire at the outside of the pin 29 and the other end of the wire 27 is connected to a wire 36 through a wire adjusting device 34. On the other hand, a wire 28 passes through the hole of the pin 30, a spring 33 is provided between the pin and a flange 32 fixed to an end of the wire 28, and the other end of the wire 28 is connected to a wire 37 through a wire adjusting device 35.

The wire 36 is connected to a lever 38 and the wire 37 is operatively connected to a lever 29 secured to a shaft 41 rotatably supported by bearings at both ends. The lever 38 is slidably engaged in a cylinder 40 secured to the shaft 41 and also connected to the cylinder 40 by a piston cylinder device 42. The piston cylinder device 42 is operated by hydraulic means or electromagnetic means. Thus, the lever 38 is moved outwardly and inwardly by the operation of the piston cylinder device 42. The length of the lever 38 plus cylinder 40 when the lever is retracted is equal to the length l of the lever 39, and when the lever 38 is extended, the length is twice (2l) as long as the lever 39. The lever 39 is connected to an accelerator pedal (not shown) by an accelerator wire 43.

Adjacent to throttle shafts 23 and 24, microswitches 44 and 49 are provided. The microswitch 44 is closed by the lever 25 when the throttle valve 21 is fully opened. The microswitch 49 is located at an intermediate position and so arranged as to be closed by the lever 26 when the throttle valve 22 is closed from a wide throttle position, and not to be closed when the throttle valve is opened from a closed position.

Figure 7:
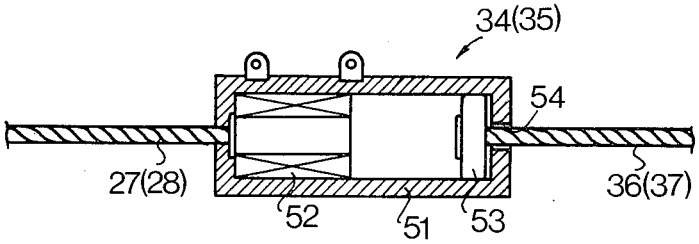
FIGS. 7 and 8 are sectional views of control members.
Figure 8:
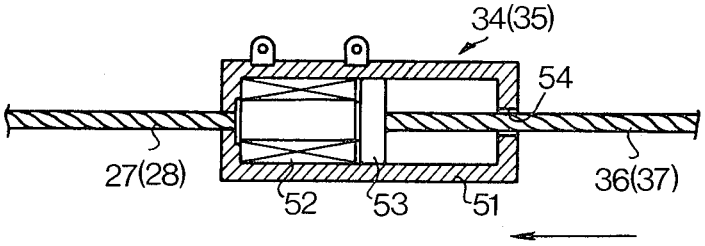

As shown in FIGS. 7 and 8, each wire adjusting device 34 (35) comprises a cylinder 51 fixed to the wire 27 (28), a coil 52, and an armature 53 fixed to the end of wire 36 (37).

Referring to FIG. 5, microswitches 44 and 49 are connected to a control circuit, the output of which is connected to a switching circuit 48 and a driving circuit 46. Outputs of the switching circuit 48 are connected to wire adjusting devices 34 and 35 and the piston cylinder device 42. The output of the driving circuit 46 is connected to the clutch 12.

In order to start the engine assembly, the flywheel 15 is driven by a starter (not shown) and at the same time a signal is applied to the driving circuit 46 by the starter, so that the electromagnetic powder clutch 12 is engaged. Thus, both engine units are started. After the starting, the starter operation stops and the electromagnetic powder clutch 12 is disengaged in conjunction with the starter operation. Accordingly, only the primary engine unit 1 operates to produce the output power. Before the throttle lever 25 closes the switch 44 at the full throttle open position, the control circuit 45 produces an output signal for energizing the coil 52 of the wire adjusting device 34 (FIG. 8) and for de-energizing the coil 52 of the device 35 (FIG. 7) and for extending the piston cylinder device 42. Since the lever length of the lever 38 is twice as long as the lever 39, the moving distance of the wire 36 is also twice as large as the wire 37. The spring 33 is compressed thereby not to operate the lever 26 when the wire 28 is pulled.

Figure 2:
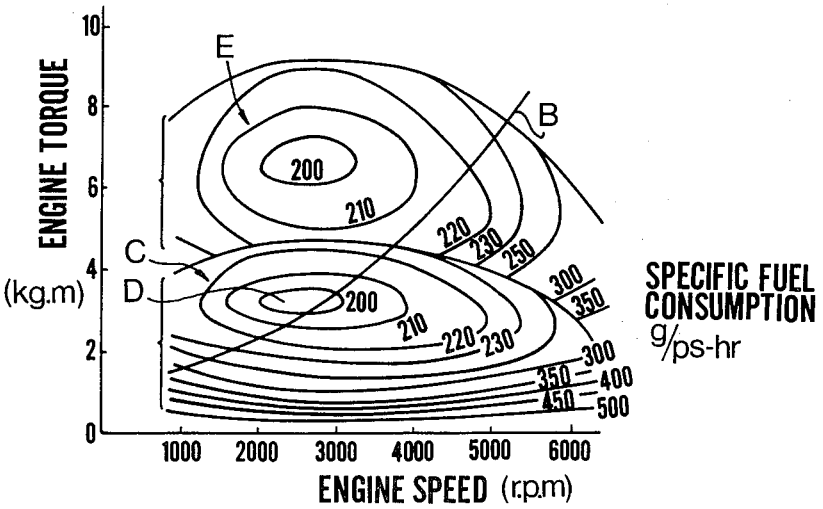
FIG. 2 is a graph showing a fuel consumption characteristic of an engine of the present invention.

In low engine torque operation by the primary engine unit, the fuel consumption characteristic is shown by the first zone C in FIG. 2 and the running load curve B passes through the minimum fuel consumption zone D. Thus, the fuel consumption of the engine assembly is low.

Figure 6:
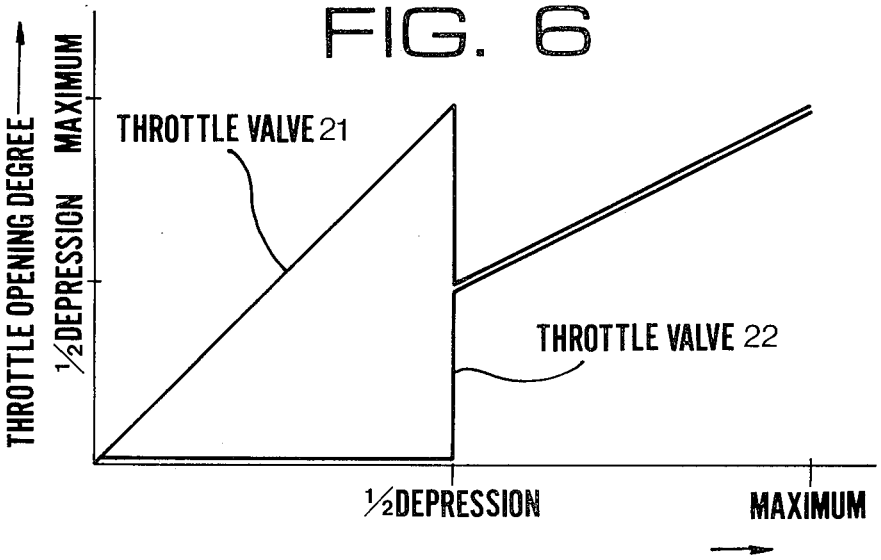
FIG. 6 is a graph showing a relationship between depression of an accelerator pedal and opening degree of throttle valves.

When the throttle valve 21 is fully opened, the microswitch 44 is closed by the lever 25. The closing of the microswitch 44 causes the control circuit 45 to produce an inverted signal, so that the wire adjusting device 34 is de-energized to extend the wire 27 and the wire adjusting device 35 is energized to retract the wire 28, and the piston cylinder device 42 is contracted. At the same time, a signal is fed to the driving circuit 46 so that the clutch 12 is engaged. Thus, the throttle valve 21 is returned to a half open position and the throttle valve 22 is opened to a half open position as shown in FIG. 6. Thereafter, both throttle valves 21 and 22 are opened together and both engine units 1 and 2 co-operate.

When the engine assembly speed is decelerated and the lever 26 passes the switch 49 from the full open position, the switch 49 is closed. The control circuit 45 produces a signal by the signal of the switch 49, so that states of the devices 34, 35 and 42 are inverted and the clutch 12 is disengaged. Thus, the throttle valve 21 is fully opened and the throttle valve 22 is closed to establish the single engine operation by the primary engine unit 1.

Figure 9:
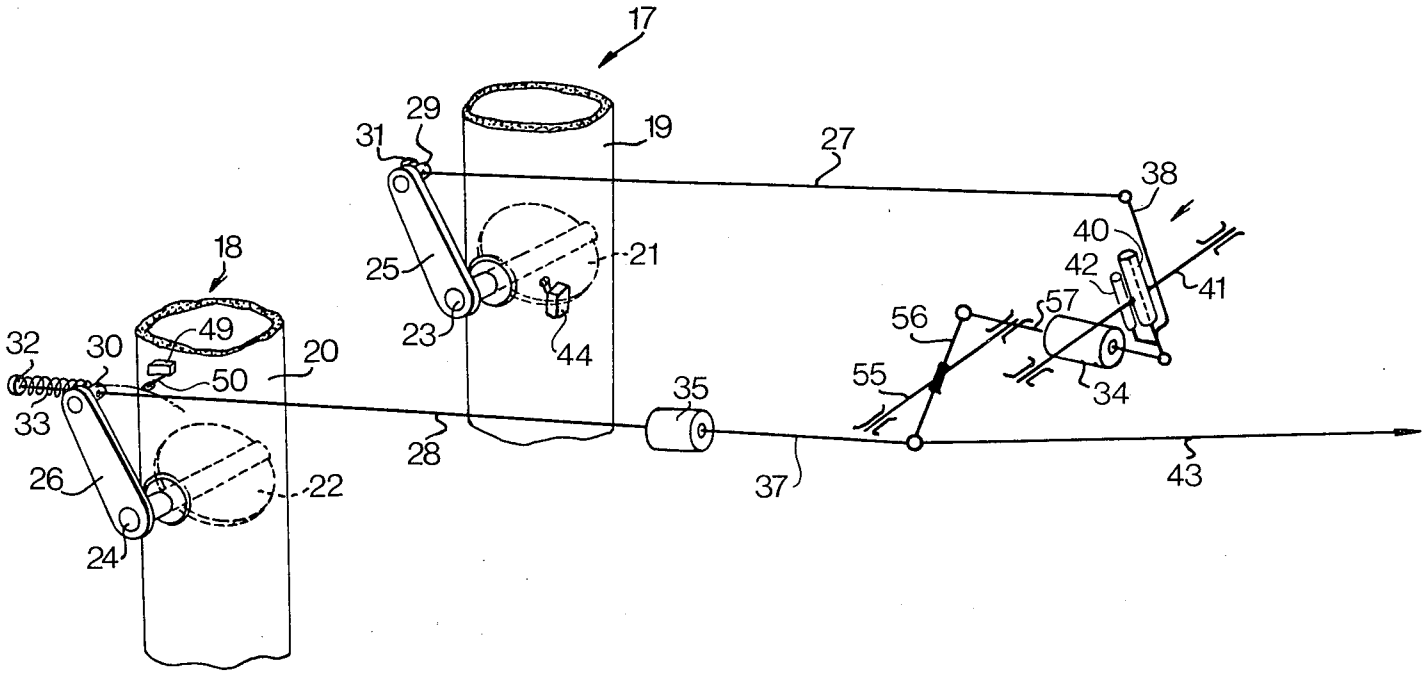
FIG. 9 is a schematic perspective view showing another embodiment of the present invention.

The embodiment of FIG. 9 is basically the same as the above described embodiment. The wire 37 is operatively connected to one end of a lever 56 which is secured to a rotatably mounted shaft 55 at a middle position thereof. The other end of lever 56 is operatively connected to the wire adjusting device 34 by a link 57. The lever 38 is inserted in the cylinder 40 which is secured to the shaft 41 at a middle position of the cylinder 40. The operation of this embodiment is the same as the previous embodiment.

PROBABILITY OF INDUSTRIAL EXPLOITATION

The engine assembly according to the present invention comprises at least one primary engine unit and one auxiliary engine unit, the primary engine unit is connected to an output shaft and the auxiliary engine unit is connected to the output shaft through a clutch, and further comprises a control system including detecting means for detecting positions of throttle valves of both engine units. By the control system, when the throttle valve of the primary engine unit is fully opened, the throttle valve of the auxiliary engine unit is opened to a half open position and the throttle valve of the primary engine unit is closed to a half open position. Thereafter both engine units co-operate together. Thus, the auxiliary engine unit is connected to the output system of the primary engine unit under balanced conditions in output torque and engine speed. Thus, the vehicle is driven by the engine assembly at a low fuel consumption in a wide operation range of the engine.

I claim:

1. An internal combustion engine for a vehicle, which comprises a plurality of independent engine units including a primary engine unit and an auxiliary engine unit, and an output shaft, characterized in that the primary engine is connected to the output shaft and the auxiliary engine unit is connected to the output shaft through a clutch, that a control system is so arranged that when a throttle valve of the primary engine unit is fully opened, a throttle valve of the auxiliary engine unit is opened to a half open position and the throttle valve of the primary engine unit is closed to a half open position, thereafter both throttle valves are opened together.

* * * * *